US006378363B1

(12) United States Patent
Hache et al.

(10) Patent No.: US 6,378,363 B1
(45) Date of Patent: Apr. 30, 2002

(54) METHOD FOR OBTAINING LEAK-OFF TEST AND FORMATION INTEGRITY TEST PROFILES FROM LIMITED DOWNHOLE PRESSURE MEASUREMENTS

(75) Inventors: Jean-Michel Hache, Houston; Iain Rezmer-Cooper, Sugar Land; Kais Gzara, Stafford, all of TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/443,537

(22) Filed: Nov. 19, 1999

Related U.S. Application Data

(60) Provisional application No. 60/122,730, filed on Mar. 4, 1999.

(51) Int. Cl.[7] ..... E21B 44/00; E21B 47/00

(52) U.S. Cl. ..... 73/152.46; 73/152.54; 73/152.51; 166/250.007; 175/40; 702/6

(58) Field of Search ..... 73/152.46, 152.54, 73/152.51, 152.03, 152.62, 37, 40; 702/6, 9; 166/250.07, 250.08; 175/40

(56) References Cited

U.S. PATENT DOCUMENTS

| | | | | | |
|---|---|---|---|---|---|
| 3,985,027 | A | * | 10/1976 | Tricon | 73/151 |
| 4,120,097 | A | | 10/1978 | Jeter | |
| 4,142,411 | A | * | 3/1979 | Deal | 73/155 |
| 4,316,386 | A | * | 2/1982 | Kerekes | 73/151 |
| 4,398,416 | A | * | 8/1983 | Nolte | 73/155 |
| 4,733,232 | A | * | 3/1988 | Grosso | 340/861 |
| 5,252,031 | A | * | 10/1993 | Gibbs | 417/53 |
| 5,303,582 | A | * | 4/1994 | Miska | 73/155 |
| 5,654,503 | A | | 8/1997 | Rasmus | |
| 5,812,068 | A | * | 9/1998 | Wisler et al. | 340/855.5 |
| 5,952,569 | A | * | 9/1999 | Jervis et al. | 73/152.01 |
| 6,220,087 | B1 | * | 4/2001 | Hache et al. | 73/152.46 |

OTHER PUBLICATIONS

C.D.Ward and E. Andreassen, "Pressure while Drilling Data Improves Reservoir Drilling Performance," *SPE/IADC 37588*, presented at the 1998 SPC/IADC Drilling Conference in Amsterdam, the Netherlands (Mar. 4–6, 1997).

P.L. Moore, *Drilling Practices Manual*, pp. 292–295, PennWell Books (Tulsa, Oklahoma 1974).

(List continued on next page.)

*Primary Examiner*—Hezron Williams
*Assistant Examiner*—David J. Wiggins
(74) *Attorney, Agent, or Firm*—John J. Ryberg; Jennie (JL) Salazar

(57) ABSTRACT

The present invention presents a method that effectively restores the real-time advantage of annular pressure while drilling (APWD) measurements taken during certain drilling operations that require the mud circulation pumps to be turned off (a "pumps-off" condition). APWD data, such as pressure measurements, is obtained from instruments and related electronics within the BHA. APWD data can be measured, stored and even processed in the BHA during a pumps-off condition for subsequent processing or communication of a reduced amount of data to the driller at the surface.

17 Claims, 4 Drawing Sheets

OTHER PUBLICATIONS

A. Bourgoyne Jr., K. Millheim, M. Chenevert & F. Young Jr., *Applied Drilling Engineering*, SPE Textbook Series, v. 2, pp. 292–294 (Richardson, Texas 1986).

R. Rudolf, P. Suryanarayana, "Field Validation of Swab Effects while Tripping–in the Hole on Deep, High Temperature Wells," *IADC/SPE* 39395, pp. 835–840, presented at the 1998 IADC/SPE Drilling Conference (Dallas, Texas Mar. 3–6, 1998).

M. Hutchinson, Iain Rezmer–Cooper, "Using Downhole Annular Pressure Measurements to Anticipate Drilling Problems," *SPE* 49114, pp. 535–549, presented at the 1998 SPE Annual Technical Conference (New Orleans, Louisiana Sep. 27–30, 1998).

P. Isambourg and D. Bertin, "Field Hydraulic Tests Improve HPHT Drilling Safety and Performance," *SPE* 49115, pp. 551–563, presented at the 1998 SPE Annual Technical Conference (New Orleans, Louisiana Sep. 27–30, 1998).

C. Ward and R. Clark, "Anatomy of a Ballooning Borehole using PWD," *Elf Exploration Production* F–64018, pp. 213–220 (1998).

P.Charlez, M.Easton, G. Morrice and P. Cenergys, "Validation of Advanced Hydraulic Modeling using PWD Data," *OTC* 8804, pp. 1–9, presented at 1998 OTC Conference (Houston, Texas May 4–7, 1998).

W.Aldred, J.Cook, P.Bern, B.Carpenter, M.Hutchinson, J.Lovell, I.Rezmer–Cooper, & P.Leder, "Using Downhole Annular Pressure Measurements to Improve Drilling Performance," Schlumberger *Oilfield Review*, pp. 40–55 (Chester, England Winter 1998).

"PWD® Service Helps Optimize Drilling Efficiency," Sperry–Sun Drilling Services *Technology Update* Spring 1998 (Apr. 1998).

* cited by examiner

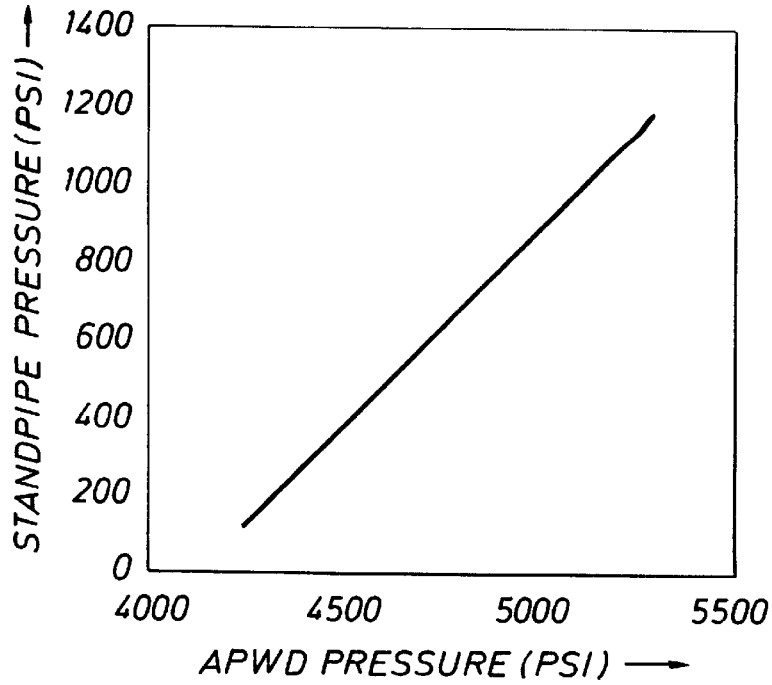
FIG. 2
FIG. 3A
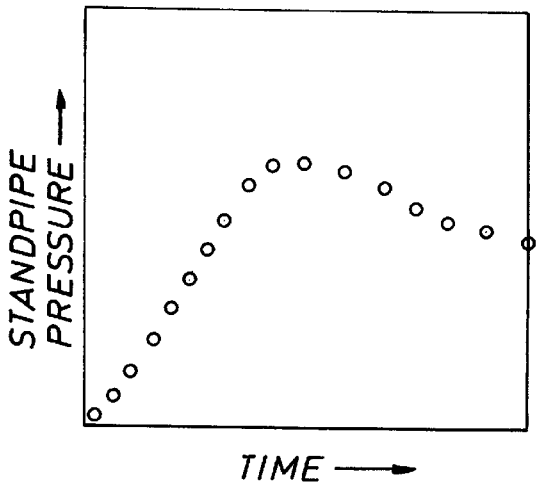
FIG. 3B
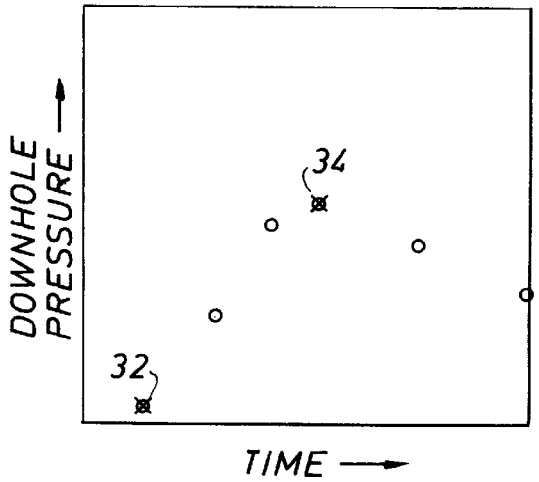

METHOD FOR OBTAINING LEAK-OFF TEST AND FORMATION INTEGRITY TEST PROFILES FROM LIMITED DOWNHOLE PRESSURE MEASUREMENTS

This is a continuation application claiming priority from provisional patent application serial No. 60/122,730 filed on Mar. 4, 1999.

BACKGROUND OF THE INVENTION

1. Field of the Invention

The present invention provides an improved method for design and control of drilling operations.

2. Background of the Related Art

Wells are generally drilled to recover natural deposits of hydrocarbons and other desirable, naturally occurring materials trapped in geological formations in the earth's crust. A slender well is drilled into the ground and directed to the targeted geological location from a drilling rig at the surface. In conventional "rotary drilling" operations, the drilling rig rotates a drillstring comprised of tubular joints of drill pipe connected together to turn a bottom hole assembly (BHA) and a drill bit that is attached to the lower end of the drillstring. During drilling operations, a drilling fluid, commonly referred to as drilling mud, is pumped and circulated down the interior of the drillpipe, through the BHA and the bit, and back to the surface in the annulus. It is also well known in the art to utilize a downhole mud-driven motor, located just above the drill bit, that converts hydraulic energy stored in the pressurized drilling mud into mechanical power to rotate the drill bit.

To isolate geologic formations from the wellbore and to prevent collapse of the well, the well is generally cased with tubular pipe joints connected together with threaded connections to form a casing string. The casing string is generally installed in stages, a section of casing being installed in each stage. A section of casing generally comprises many connected joints of casing, all sections linked together to form the casing string.

Each section of casing is installed and cemented into place in the wellbore by circulating cement into the annular area defined by the outer surface of the section of casing and the inner bore wall of the wellbore. Casing sections are generally installed in successively decreasing diameters so that subsequent smaller diameter sections of casing can be installed and cemented in deeper portions of the well as drilling progresses. Installation of a section of casing requires the driller to remove the drillstring, including the BHA and the bit, from the well. The drillstring is removed from the well joint by joint in a time-consuming operation. Later, after the section of casing is cemented into place and the cement has sufficiently cured, the drillstring is again tripped into the well joint by joint before drilling operations can resume.

There is a strong cost-based incentive to maximize the length of each section of casing and to minimize the frequency of drilling rig downtime for tripping drillpipe out of and into the well. If the number of casing stages can be safely reduced using more accurate methods of assessing downhole conditions and estimating downhole pressures, then the well can be drilled faster and with considerably lower cost for the drilling rig and related support.

The pressure of porous and permeable geologic formation (s) is generally balanced by hydrostatic pressure applied by the column of drilling mud plus the pressure applied to or held on the well at the surface. Pressure may be applied in the drillstring by mud pumps to cause mud to circulate down the interior of the drillstring, through the bit and back up to the surface through the annulus. Drilling mud is designed to suspend and carry back to the surface small bits of rock called cuttings that are produced by the drilling process. Pressure may be held on the casing when the annulus is isolated from the atmosphere by closure of the blow-out preventers (BOPs) at the surface.

The driller generally controls hydrostatic pressures in the well by use of weighting agents added to the drilling mud to increase density. The driller generally controls the pressure on the well at the surface by activation or deactivation of the mud circulating pumps and by using the BOPs to isolate the annulus from the atmosphere. However, the driller cannot always control pressures occurring downhole at the formation because other factors affect the pressure applied to the formation at any given moment. These other factors include:

(a) pipe movement in the wellbore (rotation or reciprocation), (b) temperatures and temperature gradients, (c) pressure gradients and propagation rates of pressure fronts, (d) viscosity and thixotropic properties of the drilling mud (e) loading of cuttings from drilling, and (f) fluid flows into and out of the wellbore.

Many types of geologic formations commonly encountered in drilling will fracture and fail if subjected to excessive pressure applied in the wellbore. Many types of fluid-bearing geologic formations are porous or permeable, and may either flow fluid into the wellbore or accept fluids from the wellbore. It is generally desirable to keep the pressure in the well adjacent to such formations above the pore pressure of porous formations and below the formation fracture pressure of exposed formations. This "window of safety" defined by the range of pressure between the pore pressure and the formation fracture pressure must be determined by the driller in order to design a safe and effective drilling plan and to make good decisions throughout the drilling process. Accurate determination of this window of safety directly effects the economic success of the drilling venture.

If the downhole pressure exceeds the formation fracture pressure, the region of the formation exposed to the downhole pressure will begin to physically break down and drilling mud will flow from the wellbore into the fractured formation at a rate determined by the extent of the fracture and the pressure differential. The resulting loss of overall height of the hydrostatic column of drilling mud can quickly result in inadequate well pressure at the formation. When this condition occurs, formation fluids, including gases, may enter the well from other formations in fluid communication with the well. This occurrence is commonly referred to as a kick. Once introduced into the wellbore, the gas migrates upwardly through the drilling mud towards the surface. The upwardly migrating gas expands as it encounters lower pressures, often forcing drilling mud to flow out of the well either at the surface or into formations in fluid communication with the well. This is a dangerous well control situation that must be avoided or responded to quickly. It is important that the driller avoids inadvertent fracturing of formations.

A well control situation can also develop if the pressure at the formation face falls below the pore pressure of fluids that may reside in porous formations. This well condition is commonly referred to as underbalanced. When the well is underbalanced, fluids from porous geologic formations that are in fluid communication with the well will flow into the well, displacing drilling mud upwardly towards the surface. As with the formation fracture, gas introduced through underbalanced conditions will also migrate to the surface and expand.

The "window of safety" or range of allowable downhole pressures may be defined by formation pore pressures (minimum) and the formation fracture pressure (maximum). Accurate determination of this window of safety has become increasingly important as technology has progressed and wells are drilled:

(a) in deep water locations where water temperature and depth affect changes in well design and dynamics, (b) as higher formation pore pressures, or formations with lower fracture pressures are encountered, (c) in extended reach wells drilled using directional drilling techniques, (d) in wells with extremely slender boreholes with increased friction losses for required circulating mud pressures, and (e) in extreme conditions of pressure and temperature, referred to as HPHT wells (high-pressure and high-temperature wells).

The driller can determine the pore pressure of fluid-bearing formations in a number of ways well known in the art. The driller can perform a leak-off test/formation integrity test (LOT/FIT) to test cement placed behind casing (LOT) and to test any exposed formation(s) to determine the pressure at which the formation will fracture or mud will be lost into the formation (FIT). A LOT/FIT is generally performed by first closing the BOPs at the surface to isolate the well from the atmosphere, and then pumping drilling mud into the wellbore from the surface at a slow, constant volumetric flowrate to increase the pressure in the well. The pumping continues, either continuously or in volumetric increments with intermittent static periods, until a predetermined test pressure is reached or until drilling fluid loss from the well is detected. If the cement placed behind the casing is sound, drilling fluid loss usually occurs when an exposed formation begins to fracture or accept fluid from the well.

The formation fracture pressure is calculated or determined using the LOT/FIT test results. Initially, a plot of surface (injection) pressure versus cumulative volume pumped will define an upwardly sloping, straight line as shown in FIG. 1. When the mud pressure at the downhole, exposed formation exceeds its formation fracture strength, the formation starts taking fluid from the wellbore and the injection pressure will either decline or increase non-linearly with-further increases in the volume pumped. That is, once the formation fracture pressure is reached, additional incremental increases in injection pressure cause greater volumes of mud displacement into the formation. This relationship is shown on FIG. 1, and the formation fracture pressure at point 10 in this example corresponds to the magnitude of the injection pressure where non-linear deviation occurs. The formation fracture pressure is often calculated as the surface or injection pressure at which the non-linear deviation occurs plus the hydrostatic pressure as calculated by the product of the density of the drilling mud times the vertical height of the mud column above the formation.

One problem with this method is that the formation fracture pressure calculated fails to take into account the effects of several factors that may affect the actual pressure in the well at the formation. For example, the formation fracture determined by the graphical analysis described above does not necessarily correspond to the exact time at which fluid starts to flow into the fracturing formation. Also, if the openhole section (below the cemented sections of the casing) passes through a permeable zone, fluid could be leaking from the well at a constant rate during the LOT/FIT. This scenario would still result in a linear pressure-volume plot during the LOT/FIT. Other factors that theoretically affect the pressure in the wellbore adjacent to the formation include, but are not limited to: 1) mud compressibility, 2) elastic and inelastic expansion of the wellbore and casing, 3) elastic expansion and elongation of the drillstring, 4) non-uniform dispersal of cuttings and mud weighting agents in the drilling mud, 5) non-uniform density of the mud throughout the mud column; 6) pressure propagation speeds through the mud column, 7) gel properties of the mud system, and 8) frictional pressure losses due to wellbore geometry and mud rheology.

Downhole instruments have been developed to provide accurate measurements of downhole pressures. Some of these instruments have a hard-line or cabled connection for transmitting data back to the surface. These instruments are usually slim pieces of equipment that are run into the well inside the drillstring. In these types of systems, the amount of real-time data that can be transmitted to and used by the driller at the surface is virtually unlimited. However, most hard-line or cabled instruments cannot be used without severely impairing drilling operations. The cable and the instrument must be withdrawn from the well during drilling operations when the data is needed most. Cabled instruments can also be run into the well after the drillstring is removed from the wellbore, but again this is impractical for efficient drilling operations and does not provide "real time" (or near "real time") information while drilling.

A mud pulse telemetry communication system for communicating data from the BHA to the surface has been developed and has gained widespread acceptance in the industry. Mud pulse telemetry systems have no cables or wires for carrying data to the surface, but instead use a series of pressure pulses that are carried to the surface through flowing, pressurized drilling fluid. One such system is described in U.S. Pat. No. 4,120,097. The limitation with mud pulse telemetry systems is that data transmission capacity, or information transmission rate, is extremely limited. Also, data gathered and/or stored downhole in bottom-hole assemblies (BHA) can only be transmitted to the surface using mud pulse telemetry during a "pumps-on" condition, which is defined as when the mud circulation rate is above the mud pulse telemetry operating threshold. Accordingly, during "pumps-off" operations, which are defined as when mud circulating pumps are inactive or during low pump rate operations such as LOT/FIT and during pipe joint connections, no downhole data can be transmitted to the surface using mud pulse telemetry systems. The data gathered and stored in the BHA during these pumps-off operations can only be transmitted to the surface after the circulating pumps have been turned back on, and even then, the data transmission is very slow.

Attempts have been made to formulate a predictor equation for use in estimating downhole conditions, including pressure, based on surface measurements. Rasmus discloses in his U.S. Pat. No. 5,654,503 a method for obtaining improved measurement of drilling conditions. Rasmus attempts to overcome the limited information transmission rate of mud pulse telemetry systems by formulating a predictor equation relating a surface condition to a related downhole condition at a given time. The Rasmus predictor equation is formulated by using a downhole instrument in the BHA to make numerous downhole measurements over a given time period. Rasmus then averages these measurements in a downhole CPU, and sends the averaged downhole Addition measurement to the surface for comparison with actual related surface condition measurements.

The Rasmus method may be used to approximate downhole pressure based on surface pressure. However, the Rasmus method fails to compensate for influences from pipe movement (rotation or reciprocation), temperature gradients, pressure gradients and propagation, viscosity and thixotropic properties of the drilling mud, and fluid flow into and out of the wellbore, or combinations of these influences, that can cause deviations and transients in the downhole measurements. By taking an average of numerous measurements of the downhole pressure, the Rasmus method irreversibly mixes the influence of these transients into the averaged downhole value, which is then communicated to the surface for comparison to an accurate surface pressure measurement. Furthermore, the Rasmus method uses a cumbersome sequencing technique to time-shift and re-align downhole data averages with selected surface measurements. In other words, it correlates an average taken over a given period of time, for example, 30 seconds, with a single surface measurement taken sometime during or prior to that 30 seconds. Substantial inaccuracies are introduced in the averaging step, and again in the time sequencing step, and these result in a poor approximation of coefficients used in the Rasmus predictor equation to estimate downhole pressures and to diagnose well conditions.

What is needed is a method of estimating downhole pressure that allows the driller to use a limited amount of strategically selected pressure data taken downhole, along with readily available surface pressure data, to accurately estimate formation fracture pressure and other critical downhole pressures, and to diagnose well conditions and well behavior. What is needed is a method of selecting and communicating only those specific downhole measurements that provide the most beneficial information for quickly and accurately correlating to related surface pressure measurements, and then estimating downhole pressures, diagnosing exhibited well behavior and responding to developing well conditions. It would be desirable if this method would enable the driller to better estimate formation fracture pressures by determining and updating an equation that, through the use of parameters, takes into account the transients introduced by factors known to affect downhole pressures. It would also be desirable if this method would enable the driller to avoid the time-consuming step of circulating mud in the well for a period of time prior to the LOT/FIT in order to condition the mud and promote uniform density through mixing.

SUMMARY OF THE INVENTION

The present invention provides a method of determining downhole pressures occurring during a pumps-off condition, such as during a leak-off test or formation integrity test (LOT/FIT). The method comprises measuring the wellbore pressure at the surface during the pumps-off condition. The pressure in the well is then increased as part of the condition, for example the LOT/FIT. Maximum and minimum pressures occurring downhole during the pumps-off condition are measured by the BHA and, immediately following the resumption of pumps-on operation, the maximum and minimum downhole pressure measurements are communicated to the surface. Then, the downhole maximum and minimum pressures are correlated with the maximum and minimum surface pressure measurements to arrive at one or more representative downhole pressures using the correlation.

Optionally, the method may further comprise the steps of measuring additional downhole pressure measurements, recording the times at which each of the additional downhole pressure measurements were made, and communicating the additional downhole pressure measurements and their corresponding "time-stamps" to the surface after the pumps-off condition. The additional downhole measurements communicated to the surface allow further correlation with related surface pressure measurements occurring simultaneously or in a spaced time relationship with each downhole measurement. The preferred application for these methods is a LOT/FIT, wherein the pressure in the well is increased by injection of fluid, such as drilling mud.

The invention also provides a similar method that includes measuring a first downhole pressure and a second downhole pressure during the pumps-off condition along with the times at which each measurement occurs. These first and second downhole pressure measurements, along with their respective time-stamps, are communicated to the surface immediately following the resumption of pumps-on operations. This allows a correlation of the first downhole pressure to the surface pressure occurring simultaneously, or in a spaced time relationship, with the first downhole pressure, and correlation of the second downhole pressure to the surface pressure occurring simultaneously, or in a spaced time relationship, with the second downhole pressure. Using this correlation, it is possible to arrive at one or more representative downhole pressures as a function of the measured surface pressures.

DESCRIPTION OF DRAWINGS

So that the features and advantages of the present invention can be understood in detail, a more particular description of the invention, briefly summarized above, may be gained by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

FIG. 2 is a graph showing the linear relationship of measured surface pressure versus measured downhole annular pressure (also referred to as APWD, or annular pressure while drilling).

FIG. 3 is a graph showing the relative locations of the minimum and maximum downhole annular pressure measurements as compared to other downhole and surface pressure measurements.

DETAILED DESCRIPTION OF THE INVENTION

The present invention presents a method that effectively restores the real-time advantage of annular pressure while drilling (APWD) measurements taken during certain drilling operations that require the mud circulation pumps to be turned off or significantly reduced in flow rate (hereinafter a "pumps-off" condition). APWD data, such as pressure measurements, are obtained from instruments and related electronics within the BHA. APWD data can be measured, stored and even processed in the BHA during a pumps-off condition for subsequent communication of a reduced amount of data or processed data to the driller at the surface.

APWD measurements are communicated to the driller at the surface using mud pulse telemetry systems during pumps-on operations. Pumps-on operations occur when the mud circulating pumps are active, and mud is circulating down the drillstring interior and back up to the surface through the annular area (called the "annulus") defined by the exterior of the drillstring and the interior of the casing or uncased wellbore wall. During pumps-off operations, such as an LOT/FIT or when joints of drill pipe are being connected to the drillstring, mud pulse telemetry communications are unavailable. The driller must wait until the resumption of pumps-on operations before the APWD data measured or stored in the BHA can be transmitted to the surface.

Data transmission density or capacity is another limitation of mud pulse telemetry communication. Generally, analog APWD data is converted by a logic circuit or central processing unit (CPU) in the BHA to digital form. When pumps-on operations resume after the LOT/FIT, the stored data is transmitted from the BHA to the surface one bit at a time, typically at a rate no faster than 10 bits per second, making transmission of pressure readings extremely slow. While many APWD measurements may be taken, recorded and stored in the BHA, communication of data from the BHA to the surface cannot commence until after pumps-on operations resume. As a result of the low information transmission rate of drilling mud and rapid changes in wellbore conditions, very few APWD measurements can currently be communicated to the surface fast enough for it to be reasonably useful to the driller for near real-time control of the drilling operations.

While obtaining more accurate downhole pressure estimates is the primary focus of this invention, it is within the scope of the present invention to use the estimating and correlating process disclosed herein with any well parameter of interest. Similarly, while the invention is described as overcoming the limited information transmission rate of mud pulse telemetry systems, all other information communications improved through use of selectively detecting, measuring, communicating and correlating critical downhole data to the surface are within the scope of the invention.

Figure 1:
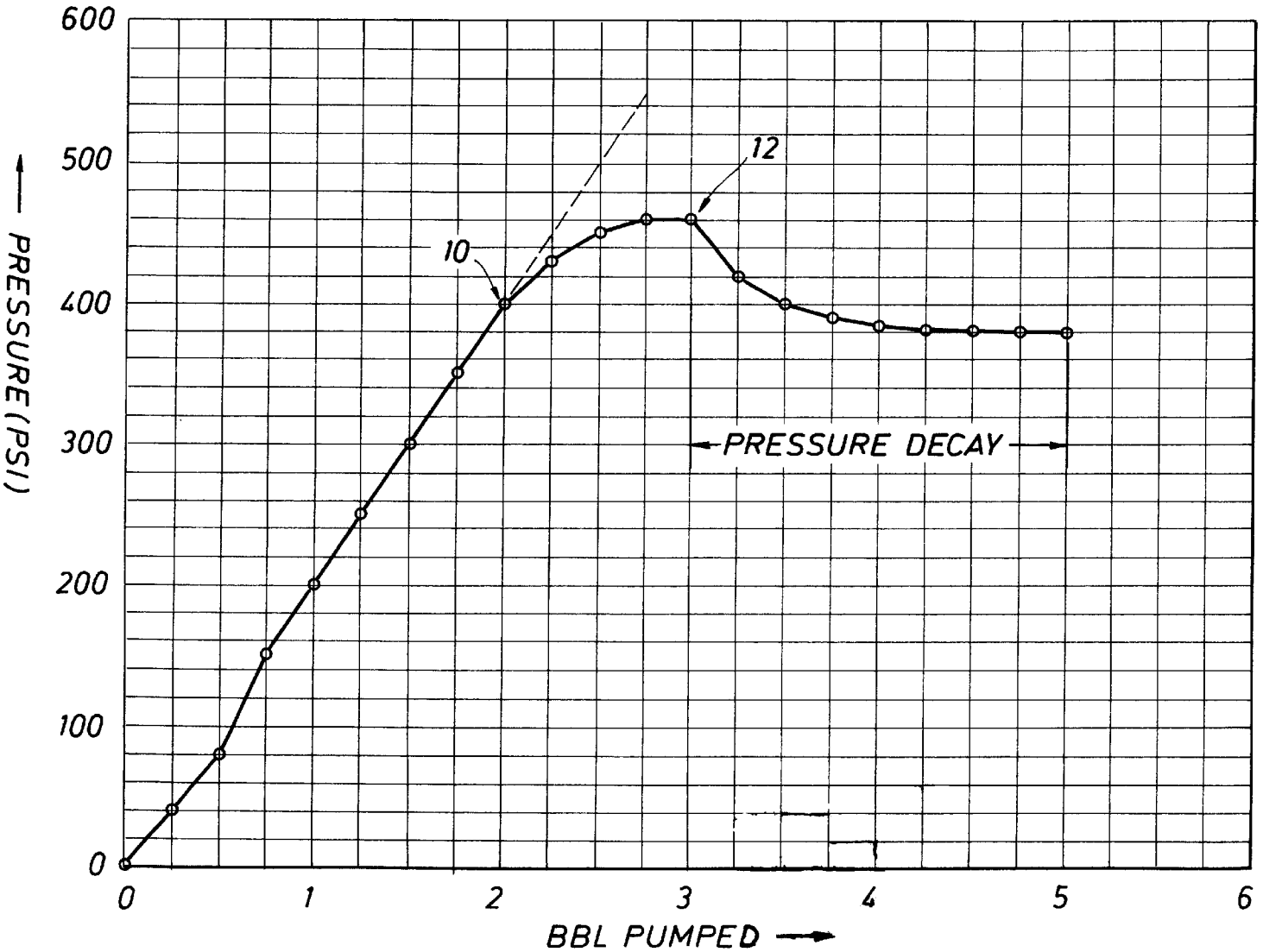
FIG. 1 is a graph of data for measured injection or surface pressure (also referred to as standpipe pressure) versus mud volume pumped during a LOT/FIT.

The LOT/FIT provides valuable information to the driller. FIG. 1 is a graph of the well pressure measured at the surface ("injection pressure") plotted against cumulative volume of fluid injected into the well at the surface. The surface pressure at which the downhole formation begins to fracture is indicated on a pressure versus volume injected plot as the point 10 at which there is deviation from the linear relationship between measured surface pressure and volume injected. In an LOT/FIT, pumping generally continues until it is confirmed that the formation is accepting whole mud from the wellbore, represented by point 12, at which time the injection pump is stopped. The results of the LOT/FIT indicate the extent of the fracture, the rate of flow into or from the formation, or the presence of casing leaks or cement channels.

The present invention overcomes the low information transmission rate of mud pulse telemetry systems to restore near real-time quality to APWD data by using downhole intelligence to strategically determine a small number of the most beneficial APWD measurements stored in the BHA or a small number of parameters that are calculated from, or representative of, the APWD measurements. The BHA then communicates the smaller amount of data to the surface using mud pulse telemetry immediately after resumption of pumps-on operations (mud pumps on and circulating). The strategically selected APWD data may include, but does not necessarily include, the maximum and minimum downhole pressure recorded during the LOT/FIT. These maximum and minimum APWD measurements are correlated to the maximum and minimum surface pressure measurements to enable the driller to estimate the downhole well pressure at any time during the LOT/FIT. The maximum APWD measurement is related to the maximum surface pressure measurement, and the minimum APWD measurement is related to the minimum surface pressure measurement. These relationships are used to correlate a relationship between any surface pressure measurement made during the LOT/FIT and the related downhole pressure.

While this estimation technique can compensate for the pressure propagation delay between related surface and downhole pressure measurements, it is preferred not to do so because the pressure propagation delay is very small and because it requires that the BHA store and transmit the times at which the maximum and minimum downhole pressures were measured. This assumption that the pressure propagation delay is very small might not hold in the case of a well drilled in deep water where there may be gelled mud in the cold water riser, and pressure transmission may be a problem. The validity of this assumption should always be checked by verifying that the plot of surface pressure versus volume pumped is indeed a straight line when pimping at a constant rate, and that there are no leaks from the well (at the start of the LOT). If this portion of the graph is non-linear, then the pumping rate has to be reduced to ensure time delays due to pressure propagation down the hole can be neglected.

Generally, the correlation between downhole or total depth pressure (PTD) and the surface or standpipe pressure (Ps) may be described by the equation:

$$P_{TD}=P_{Surface}+P_{Hydrostatic}(\text{at } t=0)+\Delta P_{Hydrostatic}-\Delta P_{Friction},$$

where $P_{Surface}$ is the surface pressure, $P_{Hydrostatic}$ is the hydrostatic pressure of the column of drilling mud, $\Delta P_{Hydrostatic}$ is the change in hydrostatic pressure, and $\Delta P_{Friction}$ is the frictional pressure drop of mud flow down the drillpipe.

$P_{Surface}$ is easily measured at the surface. $\Delta P_{Hydrostatic}$ is determined by the excess mass of the fluid injected at the surface less the mass of the fluid flowing out of the well at the total depth (TD), and by casing and/or hole deformation, if any. $\Delta P_{Friction}$ is determined by the flowrate of drilling mud into the well at the surface ($Q_{Surface}$) and flowrate of drilling mud from the well at TD ($Q_{TD}$). Given that the injection pump flow rates during a LOT/FIT are very low (typically between 0.1 and 0.25 barrels per minute), the relationship between the downhole pressure and the surface pressure is substantially linear. Furthermore, it is preferred to assume where reasonable that time delays due to propagation speeds of the pressure fronts travelling down the mud column are negligible. This assumption is deemed reasonable in light of the drastically differing time scales for the duration of the LOT/FIT (minutes) versus the actual pressure front propagation time (seconds).

Therefore, for all practical purposes:

$$P_{TD}\approx a_0+a_1.P_S,$$

where $a_0$ is a constant determined by the hydrostatic effect of the column of drilling mud, and $a_1$ is a constant determined by borehole and casing compliance and the mud compressibility and expansion.

Solving for constants $a_0$ and $a_1$ is all that is needed to generate "synthetic" or representative downhole pressures from known, related surface pressure measurements. For example, determination of the two constants $a_0$ and $a_1$ requires using the maximum and minimum downhole pressure measurements along with the related maximum and minimum surface pressure measurements, thereby providing two equations having only two unknowns, namely $a_0$ and $a_1$. Having obtained $a_0$ and $a_1$ allows use of the equation to estimate downhole pressures at any time of interest using the surface pressure measurement. The linear relationship between surface pressure and downhole pressure during a LOT/FIT and described by this equation is illustrated by FIG. 2, a plot of surface pressure measurements versus downhole annular pressure measurements during a LOT/FIT.

It should be recognized that other and further factors may be included in the correlation of the downhole pressures to surface pressures and/or the estimation of downhole pressures as a function of surface pressure. It is specifically anticipated that more robust equations may be used, including higher order variables and complex mathematical functions and that these equations may require additional downhole pressure measurements to be selected and communicated to the surface. At present, the simpler technique involving only two downhole pressure measurements is preferred because of the accuracy and speed with which the technique can be performed under limited mud pulse telemetry transmission rates. However, as higher mud pulse telemetry transmission rates become available, it may be possible to provide greater accuracy in the estimation by considering additional downhole pressure measurements or data representing characteristics of the downhole pressure measurements.

FIG. 3 shows simultaneous (with respect to time) plots of surface or standpipe pressure versus time and the downhole pressures obtained using the invention. The large "X"s 32 and 34 on the downhole graph show the locations of the downhole pressure minimum 32 and the maximum 34 APWD measurements. (Note that the maximum APWD measurement does not necessarily correspond in time to the maximum surface or standpipe pressure measurement.)

Figure 4:
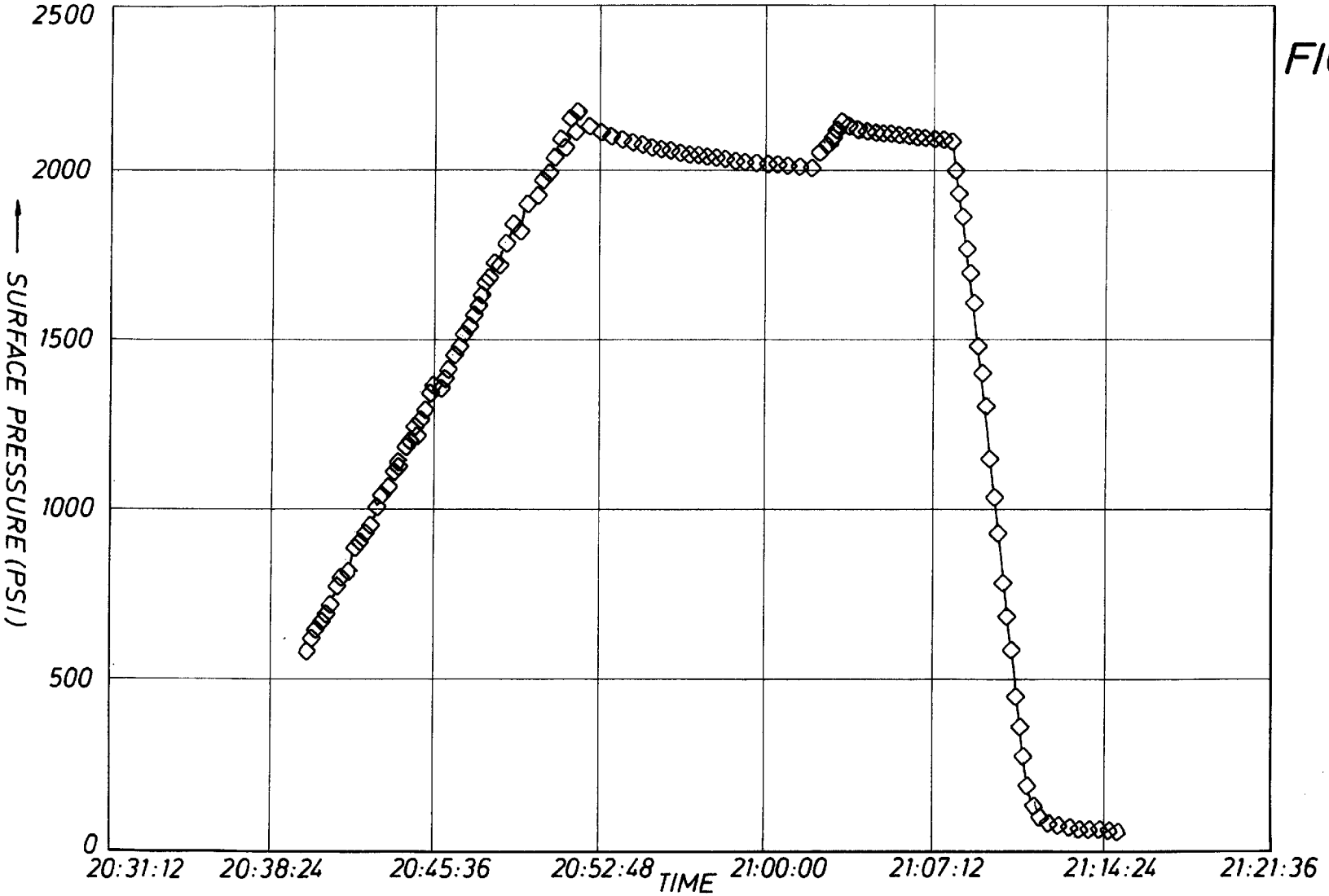
FIG. 4 is a graph of measured surface pressure versus time during a LOT/FIT.

FIG. 4 shows surface or standpipe pressure versus time during a LOT/FIT. This real-time data is readily available to the driller, and can be recorded and made available for calculations using the correlations developed with strategically selected APWD measurements.

Figure 5:
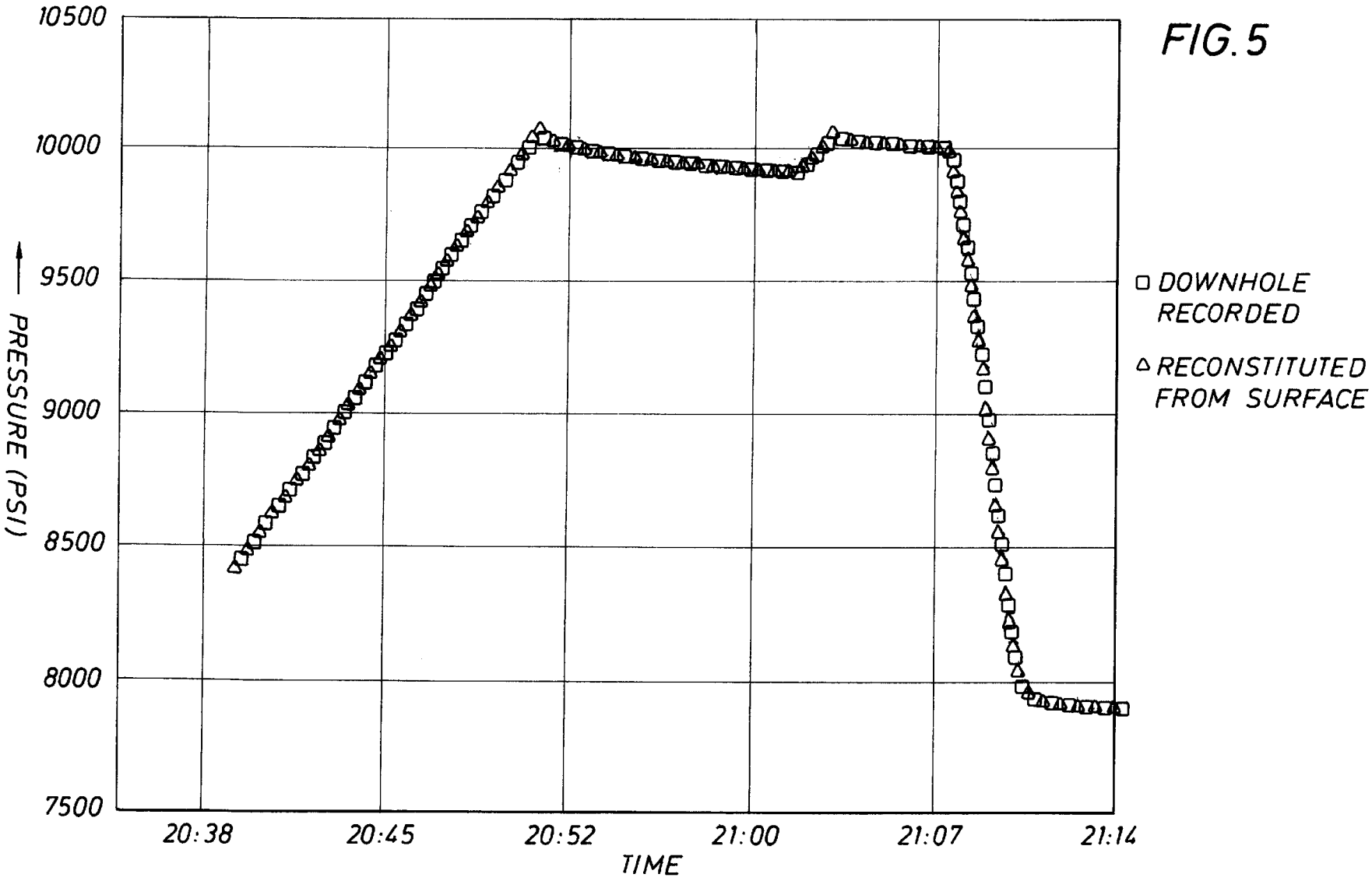
FIG. 5 is a graph showing actual downhole pressure measurements and reconstituted downhole pressure estimates, calculated with the correlation obtained using the invention, versus time during a LOT/FIT.

The accuracy of the present method is illustrated in FIG. 5, which shows a LOT/FIT profile generated through the use of the invention in comparison to a LOT/FIT profile actually measured by the APWD tool, but substantially delayed in availability to the driller due to the limited communication capacity of the mud pulse telemetry system used to communicate this data to the surface. The set of data points designated using the square symbols represent the recorded downhole (APWD) pressure measurements and the set of data points using the triangular symbols represent the reconstituted LOT/FIT downhole pressures estimated through use of the correlation as applied to the surface pressure measurements. The accuracy of the method is represented by the closeness of the estimated downhole pressure profile to the measured downhole pressure profile. Inspection of FIG. 5 reveals that the two profiles are virtually indistinguishable in the example illustrated.

The estimated downhole pressure profile can thus be used to accurately determine, within seconds of the resumption of pumps-on operations, the formation fracture pressure and other formation properties. This early information better enables the driller to stay within the window of safety between the pore pressure and the fracture pressure, and to better design the casing program for maximum safety and efficiency. This is particularly true in wells with small windows of safety between the pore pressure and fracture pressure (such as high pressure and high temperature wells, wells drilled in deep or cold water, wells with slim boreholes and directional wells), wherein this added accuracy enables the driller to avoid dangerous and expensive well control problems while avoiding the added costs of unnecessary interruptions in drilling to set casing.

One embodiment of the invention involves the measurement and communication to the surface of only two specific measurements: the maximum downhole pressure and the minimum downhole pressure. It is assumed that the maximum downhole pressure measurement occurs in a linear relationship with, but not necessarily simultaneous with, the maximum pressure measurement at the surface. Similarly, it is assumed that the minimum downhole pressure measurement occurs in accordance with the same general linear relationship with the minimum surface pressure measurement. These two downhole measurements are mathematically correlated with their respective surface counterparts by solving the simplified linear equation stated above. The correlations are then applied to solve for the downhole pressure at any time point or interval of interest using the corresponding surface pressure measurements over that time point or interval. Only two downhole measurements are needed to solve the equation for a given data pair from the BHA; the other measurements are readily available at the surface in real-time form. Using this invention, the entire LOT/FIT profile can be accurately represented, thereby providing the driller with critical and reliable information enabling him to manage the drilling process with maximum safety and minimum costs.

A second embodiment involves the measurement and communication to the surface of two pairs of measurements. These may include two strategically selected downhole measurements occurring during a time period of interest during the LOT/FIT, along with two time measurements indicating the times during the LOT/FIT that each of the downhole pressure measurements occurred. These four data points allow the driller to correlate these data pairs to the surface pressure measurements occurring simultaneously or at a time offset to correct for pressure propagation time or other influences.

A third embodiment involves the measurement and communication to the surface of additional downhole measurements, either along with timestamps or strategically spaced in time one from the other in a known interval, all selected from a time period or pressure zone of interest to the driller. As with the second embodiment, this embodiment requires the transmission of more data by mud pulse telemetry, and the data is less readily available to the driller due to the limited information transmission rate of the mud pulse telemetry system. However, additional data points should lead to increased accuracy of the correlations, and even in other embodiments, additional data points may be communicated in a selectively queued sequence allowing the first correlations to be made, and later refined and calibrated using additional downhole measurements.

The LOT/FIT output does not necessarily need to be in terms of downhole pressure. The output may be converted to equivalent mud density and plotted along with mud density measured at the surface, or it may be graphically presented with mud density, whether measured or corrected, pore pressure and/or fracture pressures of the zone of interest and others already encountered or anticipated.

While the foregoing is directed to the preferred embodiment of the present invention, other and further embodiments of the invention may be devised without departing from the basic scope thereof, and the scope thereof is determined by the claims which follow.

We claim:

1. A method of determining a set of representative downhole pressures occurring during a pumps-off condition comprising:

measuring one or more surface pressures during the pumps-off condition;

increasing the downhole pressure in the well during the pumps-off condition;

measuring the maximum and minimum pressures occurring downhole during the pumps-off condition;

communicating the maximum and minimum downhole pressure measurements to the surface after the pumps-off condition;

correlating the downhole maximum and minimum pressures with the maximum and minimum surface pressure measurements; and estimating one or more representative downhole pressures using the one or more surface pressure measurements and the correlation.

2. The method of claim 1 further comprising the steps of:

measuring additional downhole pressure measurements;

recording the times at which each of the additional downhole pressure measurements were made;

selecting one or more of the additional measurements from a time period of interest during the pumps-off condition;

communicating the one or more additional measurements and the respective measurement times to the surface after the pumps-off condition; and correlating the downhole pressures with the surface pressure measurements.

3. The method of claim 1 wherein the pressure in the well is increased by injection of fluid into the well.

4. The method of claim 3 wherein the fluid is drilling mud.

5. The method of claim 2 wherein the correlation using the additional downhole pressure measurements and times are used to calibrate an existing correlation.

6. The method of claim 1, wherein the step of correlating the downhole pressures with the surface pressure measurements includes solving two first-order equations for a first constant and a second constant.

7. The method of claim 6, wherein the first constant defines a y-axis intercept and the second constant defines a slope.

8. The method of claim 6 wherein the first order equation is: $P_{TD}=a_0+a_1(P_s)$, wherein $P_{TD}$ is the representative downhole pressure, $P_s$ is the measured surface pressure, and $a_0$ and $a_1$ are constants.

9. The method of claim 1, wherein the step of estimating includes graphical techniques selected from interpolation, extrapolation or combinations thereof.

10. The method of claim 8, wherein the step of estimating includes calculating a representative downhole pressure using a surface pressure measurement.

11. A method of determining a set of representative downhole pressures occurring during a pumps-off condition comprising:

measuring wellbore pressure at the surface during the pumps-off condition;

increasing the downhole pressure in the well during the pumps-off condition;

measuring a first downhole pressure and a second downhole pressure during the pumps-off condition along with the times at which each occurs;

communicating the first downhole pressure and the second downhole pressure and the times at which each was measured to the surface after the pumps-off condition;

correlating the first downhole pressure to the surface pressure occurring at the time at which the first downhole pressure measurement was made, and the second downhole pressure to the surface pressure occurring at the time at which the second downhole pressure measurement was made, to arrive at one or more representative downhole pressures using the correlation.

12. The method of claim 11 wherein the pressure in the well is increased by injection of fluid.

13. The method of claim 11 wherein the fluid is drilling mud.

14. The method of claim 1 wherein the step of measuring the maximum and minimum downhole pressures is performed without a step of previously using mud circulating pumps to circulate drilling mud to increase the uniformity of the mud density.

15. The method of claim 1 wherein the step of measuring of maximum and minimum downhole pressures is not preceded by a step of using mud circulating pumps to circulate drilling mud for the purpose to promote uniform mud density.

16. The method of claim 1 wherein the pumps-off condition is a low circulation condition occurring during a leak-off test.

17. The method of claim 1 wherein the pumps-off condition is a low circulation condition occurring during a formation integrity test.

* * * * *